US005881561A

United States Patent [19]

Viard

[11] Patent Number: 5,881,561

[45] Date of Patent: Mar. 16, 1999

[54] DEVICE FOR FREEZING FLUID SUBSTANCES

[75] Inventor: Nicolas Viard, Buc, France

[73] Assignee: L'Air Liquide Societe Anonyme pour l'Etude et l'Exploitation des Procedes Georges Claude, Paris, France

[21] Appl. No.: 894,442

[22] PCT Filed: Feb. 12, 1996

[86] PCT No.: PCT/FR96/00224

§ 371 Date: Aug. 19, 1997

§ 102(e) Date: Aug. 19, 1997

[87] PCT Pub. No.: WO96/26400

PCT Pub. Date: Aug. 29, 1996

[30] Foreign Application Priority Data

Feb. 24, 1995 [DE] Germany ..... 195 06 540.9

[51] Int. Cl.[6] ..... F25D 13/06

[52] U.S. Cl. ..... 62/63; 62/74; 62/78; 62/374

[58] Field of Search ..... 62/74, 63, 374, 62/78

[56] References Cited

U.S. PATENT DOCUMENTS

| | | | |
|---|---|---|---|
| 3,228,838 | 1/1966 | Rinfret et al. | 62/74 |
| 3,413,818 | 12/1968 | Pelmulder | 62/63 |
| 4,655,047 | 4/1987 | Temple et al. | 62/74 |
| 4,748,817 | 6/1988 | Oura et al. | 62/74 |
| 4,982,577 | 1/1991 | Milankov et al. | 62/381 |
| 5,299,426 | 4/1994 | Lermeuzeaus | 62/63 |

FOREIGN PATENT DOCUMENTS 505 222 9/1992 European Pat. Off. .

*Primary Examiner*—Ronald Capossela
*Attorney, Agent, or Firm*—Burns, Doane, Swecker & Mathis, L.L.P.

[57] ABSTRACT

Device for freezing fluid substances with the aid of a cryogenic fluid comprising:

a conveying channel which conveys the substance to be frozen and the cryogenic fluid in a conveying direction relative to a horizontal, the conveying channel comprising, in the conveying direction, (i) at least one section which is inclined in relation to the horizontal to which is joined (ii) an essentially horizontal section comprising a conveying device;

a metering device; and a withdrawing device for the substance to be frozen, wherein the metering device and the withdrawing device are placed at opposite ends of the conveying channel.

21 Claims, 2 Drawing Sheets

DEVICE FOR FREEZING FLUID SUBSTANCES

The invention relates to a device for freezing fluid substances with the aid of a cryogenic fluid, in particular with the aid of liquid nitrogen.

It is known to freeze the fluid with a view to the preservation of fluids. In cases of fluids of this kind this may involve, for example, suspensions of bacteria, solutions of albumen or inoculation serums. The freezing procedure should take place as quickly and as uniformly as possible, to prevent damage due to the cold, which could appear as a result of the growth of ice crystals. The freezing procedure is usually performed by making use of a fluid gas with a low boiling point, in particular of liquid nitrogen.

A device for freezing fluid substances with the aid of a cryogenic fluid is described by J. Buchmüller and G. Weyermann in the paper called "Cryopel: Ein neues Verfahren zum Pelletieren und Frosten biologischer Substrate" [Cryopel: a new process for pelletizing and freezing biological substrates], in the publication Gaz Aktuell [Current Gas Topics] 35. The device includes an immersion freezer compartment which is constructed basically in a U shape, metering equipment and withdrawing equipment. A cryogenic fluid is in the immersion freezer compartment. By virtue of the metering equipment which is constructed in the form of equipment producing a drop, a fluid is introduced into the immersion freezer compartment. By virtue of the immersion of the drop in the cryogenic fluid the fluid freezes very abruptly at its surface. A conveyor belt which has driving members is placed in the immersion freezer compartment with a view to the removal by conveying of the pellets thus produced. The conveyor belt is endless.

A device for freezing fluid substances with the aid of a cryogenic fluid, in particular with the aid of liquid nitrogen, is known from U.S. Pat. No. 4,982,577. The device includes a receptacle in the form of a small cask, in which a conveying channel designed in the shape of a screw is placed. The conveying channel forms a slipway on which the cryogenic fluid slides with the fluid to be frozen in the form of pellets in the direction of a withdrawing equipment.

SUMMARY AND OBJECTS OF THE INVENTION

The fundamental objective of the present invention is to provide a device and a process by virtue of which it is possible to reach a high freezing efficiency, the size of the pellets being as uniform as possible.

This objective is obtained by virtue of a device according to and a process according to described below. Subsequent advantageous developments form the subject of the secondary claims.

The device according to the invention is characterized in that the conveying channel has, from the view point of the conveying direction, at least one section which is inclined to the horizontal, to which is adjoined a section arranged essentially horizontally. The section arranged horizontally has conveying equipment.

The fluid to be frozen in the form of drops is removed by conveying with the aid of the cryogenic fluid which flows in the section which is inclined in relation to the horizontal of the conveying channel. By virtue of the removal of the fluid to be frozen by immediate conveying it is ensured that the drops or the pellets do not collide with one another. It is by virtue of the fact that a collision of the drops with one another does not take place that virtually all the drops are of a uniform size.

The pellets undergo a commencement of freezing in an outer region in the section which is inclined in relation to the horizontal of the conveying channel. In the section arranged essentially horizontally of the conveying channel, which adjoins the section which is inclined in relation to the horizontal, each pellet is completely frozen individually. This is produced by the fact that the section arranged essentially horizontally has a conveying equipment, with the aid of which the speed of conveying of the pellets in the cryogenic fluid can be adjusted.

The conveying equipment is formed by virtue of the section which is inclined in relation to the horizontal, which is connected to a vibrating drive. Preference is given to a vibrating drive which involves, for example, an ultrasonic source which introduces ultrasound into the cryogenic fluid.

In order to prevent vibrations of the section arranged essentially horizontally the latter is connected resiliently to the section which is inclined to the horizontal.

Preference is given to a device in which the sections are arranged one below the other. A relatively compact device is produced by virtue of this preferred embodiment.

In order to separate the pellets from the cryogenic fluid a screen is provided in the end region of the conveying channel, by virtue of which only the cryogenic fluid arrives in the cryogenic fluid storage tank. Preference is given to an embodiment in which the cyrogenic fluid circulates in a closed circuit. To do this, the cryogenic fluid storage receptacle is connected, through the intermediacy of a conduit in which a cyrogenic fluid pump is placed, to a cryogenic fluid tank at the end of the conveying channel. Losses of cryogenic fluid due to evaporation are compensated by the addition of fresh cryogenic fluid. The addition of cryogenic fluid can take place, for example, in the cryogenic fluid storage receptacle. Addition of supplementary cryogenic fluid is also possible in other places in the cryogenic fluid circuit. Preference is given to an embodiment in which the cryogenic fluid is introduced into the cryogenic fluid tank.

The conveying channel preferably has an essentially rectangular cross-section. The conveying channel is preferably closed with the aid of side walls. The loss of cryogenic fluid is reduced thereby.

With a view to the extraction of the cryogenic fluid in vapour form from the conveying channel, the latter is connected to extraction equipment. The cryogenic fluid extracted in vapour form can be employed for cooling the withdrawing equipment.

In accordance with an advantageous additional concept, it is suggested to provide the device with equipment for spraying cryogenic fluid, which is placed in the section which is inclined in relation to the horizontal of the conveying channel. By virtue of this equipment for spraying cryogenic fluid it is ensured that the drops freeze rapidly in their outer region. This is suggested because the drops are not necessarily completely immersed in the cryogenic fluid. Preference is given to an embodiment in which the equipment for spraying cryogenic fluid has nozzles which are arranged behind one another.

The equipment for spraying cryogenic fluid is preferably placed in the vicinity of the metering equipment, with the result that the cooling power can be further increased. The term cooling power is intended to mean the flowrate of the fluid substance to be frozen in relation to time.

The temperature of the substance in the in relation transition region between the section which is inclined in relation to the horizontal and the section arranged essentially horizontally is preferably between −10° C. and −5° C., preferably between −8° C. and −6° C. The temperature of the substance at the outlet of the conveying channel is preferably at least −60° C.

With regard to the process according to the invention with a view to the freezing of fluid substances with the aid of a cryogenic fluid, in particular with the aid of liquid nitrogen, the substance to be frozen is introduced with the aid of metering equipment into the conveying channel. In the conveying channel the cryogenic fluid is introduced preferably in a region upstream of the metering equipment in relation to the flow of the cryogenic fluid. The substance is introduced in the form of drops from the metering equipment into the cryogenic fluid and is conveyed by the latter along the conveying channel in the direction of a withdrawing equipment. The conveying of the drops takes place [on] a film of cryogenic fluid which preferably has a thickness of between 3 and 4.5 mm. The substance and the film of cryogenic fluid slide along the section which is inclined in relation to the horizontal of the conveying channel and then reach the section arranged essentially horizontally of the conveying channel. In the section arranged essentially horizontally of the conveying channel the partially frozen drops are conveyed in a bath of cryogenic fluid. In this case, the conveying takes place with the aid of the cryogenic fluid which is conveyed by virtue of equipment for conveying in the direction of the withdrawing equipment. At the withdrawing equipment separation of the cryogenic fluid from the frozen drops takes place.

Other advantages and characteristics of the device according to the invention of the process are described with reference to an example of an embodiment.

DETAILED DESCRIPTION OF PREFERRED EMBODIMENTS

Figure 1:
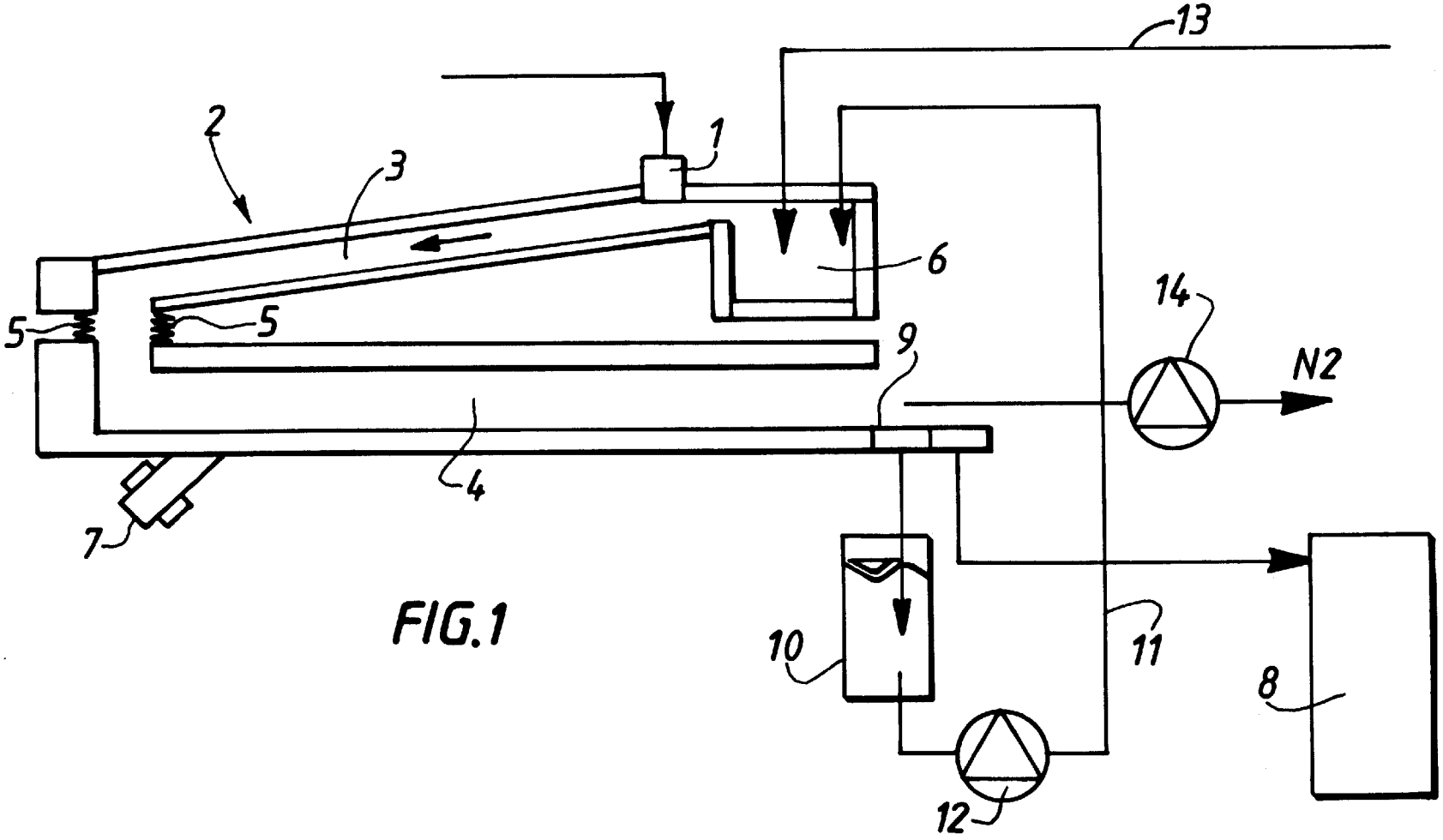
FIG. 1 depicts a schematic example of an embodiment of the device according to the invention.
Figure 2:
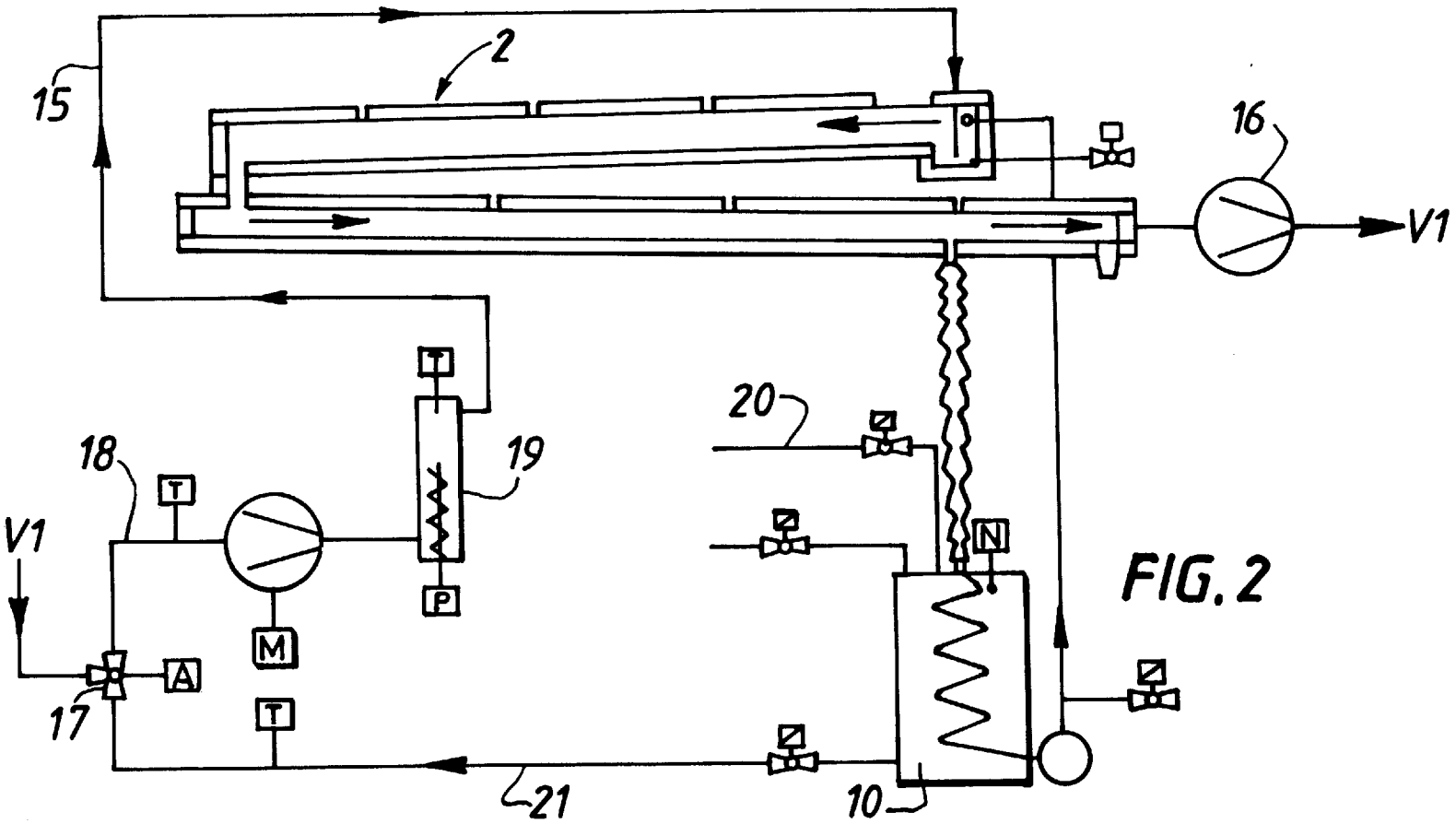
FIG. 2 depicts a schematic illustration of the device in accordance with FIG. 1 with a sterilization circuit.

The device includes a conveying channel 2, a first section 3 which is inclined in relation to the horizontal and a section 4 arranged essentially horizontally which adjoins the first sections 3. Sections 3 and 4 are arranged one below the other. Section 3 is joined to section 4 with the aid of a resilient connection.

A cryogenic fluid tank 6, into which the cryogenic fluid is introduced, is produced at the upper end of the first section 3. Before the cryogenic fluid tank 6, in the direction of flow which is indicated by the arrow S, a metering equipment 1 is prouded, through which the substance to be frozen is introduced into the conveying channel 2.

A vibrating drive 7 is placed at the section 4 of the conveying channel 2, which applies vibration to the first section 4 of the conveying channel 2, as a result of which the substance to be frozen is conveyed in the direction of withdrawing equipment 8. The withdrawing equipment 8 is shown Schematically. In the withdrawing equipment 8 a screen 9 is placed, through which the liquid cryogenic fluid arrives in a storage receptacle. The storage receptacle 10 is connected, through the intermediacy of a conduit 11, in which a cryogenic fluid pump 12 is placed, to the cryogenic fluid tank 6.

13 denotes a conduit by virtue of which fresh cryogenic fluid is introduced into the cryogenic fluid tank 6.

The vapour which forms during the cooling of the substance is sucked out of the channel 2 with the aid of an extraction equipment 14. For this purpose, the channel 2 is closed back onto itself.

Equipment for spraying cryogenic fluid, which may be placed in the first section 3 of the conveying channel 2 is not shown in FIG. 1.

Cleaning of the device can be carried out with the aid of sterile steam or hot air. For this purpose the device is connected to a sterilization circuit which can clean, on the one hand, the components of the conveying channel and, in addition, those of the nitrogen circuit. Hot air or steam is introduced through the intermediacy of a conduit 15 into the conveying channel 2 and is drawn off with the aid of a blower 16. The outlet of the blower 16 is connected to a three-way valve 17, the valve being connected to a conduit 18 which is again connected to the conduit 15, a heat exchanger 19 being inserted. The storage receptacle 10 for the cryogenic fluid has a conduit 20 through which a cleaning agent can be introduced into the storage receptacle 10. The cleaning agent introduced into the storage receptacle 10 may be drawn off through the intermediacy of a conduit 21 which is connected to the valve 17.

I claim:

1. A device for freezing fluid substances with the aid of a cryogenic fluid comprising:

a conveying channel which conveys the substance to be frozen and the cryogenic fluid in the conveying direction relative to a horizontal, said conveying channel comprising, in the conveying direction, (i) at least one section which is inclined in relation to said horizontal which is joined to (ii) an essentially horizontal section comprising a conveying device, with the inclined section being inclined sufficiently such that the substance to be frozen and the cryogenic fluid slide along the section with freezing of the substance commencing only in the outer regions, and with the essentially horizontal section holding a bath of cryogenic fluid such that the substance to be frozen is conveyed through the horizontal portion in a bath of cryogenic fluid in which complete freezing of the substance is accomplished:

a metering device; and a withdrawing device for the substance to be frozen, wherein the metering device and withdrawing device are placed at opposite ends of the conveying channel.

2. Device according to claim 1, wherein the horizontal section is placed below the section which is inclined.

3. Device according to claim 1, wherein the conveying device comprises the horizontal section and a vibrating drive.

4. Device according to claim 1, wherein the section arranged horizontally is connected resiliently to the section which is inclined in relation to the horizontal.

5. Device according to claim 1, wherein said conveying channel further comprises, in an end region of the conveying channels, a screen through which only the cryogenic fluid reaches a cryogenic fluid storage receptacle.

6. Device according to claim 5, wherein the cryogenic fluid storage receptacle is connected, through an intermediate conduit, to a cryogenic fluid tank at a front end of the conveying channel.

7. Device according to claim 6, wherein a cryogenic fluid pump is placed in the intermediate conduit.

8. Device according to claim 1, wherein said conveying channel is bounded by side walls which form a closed polygonal contour.

9. Device according to claim 8, wherein the conveying channel has a cross-section of essentially rectangular shape.

10. Device according to claim 9, further comprising an extraction device for extraction of the cryogenic fluid in vapor form connected to the conveying channel.

11. Device according to claim 1, wherein the section which is inclined in relation to the horizontal of the conveying channel further comprises a device for spraying cryogenic fluid.

12. Device according to claim 11 wherein the device for spraying cryogenic fluid comprises a plurality of nozzles placed behind one another.

13. Device according to claim 12 wherein the plurality of nozzles placed behind one another are in a row.

14. Device according to claim 11, wherein the device for spraying cryogenic fluid is placed in vicinity of the metering device.

15. Device according to claim 1, wherein the substance in a transition region between the section which is inclined to the horizontal and the section arranged essentially horizontally has a temperature which is between −10° C. and −5° C.

16. Device according to claim 15, wherein the substance in the transition region has a temperature which is between −8° C. and −6° C.

17. Device according to claim 1, wherein said conveying channel further comprises an outlet and wherein the temperature of the substance at the outlet of the conveying channel is −60° C. or less.

18. Device according to claim 1, wherein said cryogenic fluid is liquid nitrogen.

19. A process for freezing fluid substances with the aid of a cryogenic fluid comprising the steps of:

introducing the substance to be frozen into a conveying channel wherein said conveying channel conveys the substance in a conveying direction relative to the horizontal, introducing the cryogenic fluid into the conveying channel, and conveying the substance in the cryogenic fluid along the conveying channel first in a film of cryogenic fluid in a section which is inclined in relation to the horizontal of the conveying channel such that the substance begins freezing only in its outer regions, and next in a section arranged essentially horizontally in the direction of a withdrawing device, in which horizontal section the substance is conveyed in a bath of cryogenic fluid and freezing of the substance is completed.

20. Process according to claim 19, wherein said cryogenic fluid is liquid nitrogen.

21. The process according to claim 19, wherein the cryogenic fluid film is of a thickness between 3 and 4.5 mm.

* * * * *